US005181252A

United States Patent [19]

Sapiejewski et al.

[11] Patent Number: 5,181,252

[45] Date of Patent: Jan. 19, 1993

[54] HIGH COMPLIANCE HEADPHONE DRIVING

[75] Inventors: Roman Sapiejewski, Boston; John J. Breen, Southboro, both of Mass.

[73] Assignee: Bose Corporation, Framingham, Mass.

[21] Appl. No.: 782,874

[22] Filed: Oct. 16, 1991

Related U.S. Application Data

[63] Continuation of Ser. No. 138,095, Dec. 28, 1987, Pat. No. 4,922,542, and a continuation of Ser. No. 398,133, Aug. 23, 1989, abandoned.

[51] Int. Cl.[5] ..... H04R 25/00; H04R 7/00

[52] U.S. Cl. ..... 381/187; 381/183; 381/158; 181/166

[58] Field of Search ..... 381/181, 183, 158, 197, 381/74, 202; 181/166, 171, 172

[56] References Cited

U.S. PATENT DOCUMENTS

| | | | |
|---|---|---|---|
| Re. 26,030 | 5/1966 | Marchand et al. | 381/197 |
| 1,807,225 | 5/1931 | Pack | 181/164 |
| 2,379,891 | 7/1945 | Eckardt | 181/166 |
| 2,427,844 | 9/1947 | Eklov | 181/166 |
| 3,073,411 | 1/1963 | Bleazey et al. | 181/32 |
| 4,399,334 | 8/1983 | Kakiuchi et al. | 381/194 |
| 4,455,675 | 6/1984 | Bose et al. | 381/74 |
| 4,581,496 | 4/1986 | Sweany . | |
| 4,644,581 | 2/1987 | Sapiejewski | 381/187 |
| 4,922,542 | 5/1990 | Sapiejewski | 381/187 |

FOREIGN PATENT DOCUMENTS

| | | | |
|---|---|---|---|
| 0195641 | 3/1986 | European Pat. Off. . | |
| 8101815 | 11/1981 | Netherlands | 381/197 |
| 1122453A | 6/1983 | United Kingdom . | |
| 2188210A | 3/1987 | United Kingdom . | |
| 2187361 | 9/1987 | United Kingdom | 381/74 |

*Primary Examiner*—James L. Dwyer
*Assistant Examiner*—Jason Chan
*Attorney, Agent, or Firm*—Fish & Richardson

[57] ABSTRACT

An active noise reducing headset has a high compliance diaphragm. Structure limits the maximum excursion of the diaphragm so that the voice coil does not escape the air gap. Structure, such as indentations in the diaphragm, prevent unrecoverable diaphragm collapse.

6 Claims, 2 Drawing Sheets

HIGH COMPLIANCE HEADPHONE DRIVING

CROSS-REFERENCE TO RELATED APPLICATION

This application is a continuing application of copending application Ser. No. 07/138,095, filed Dec. 28, 1987, of Roman Sapiejewski entitled HEADPHONE COMFORT, now U.S. Pat. No. 4,922,542 granted May 1, 1990, and is a continuation of Ser. No. 398,133 filed Aug. 23, 1989, now abandoned.

BACKGROUND OF THE INVENTION

The present invention relates to high compliance drivers in active noise reducing headsets. Particularly, it relates to an apparatus for protecting the driver diaphragm.

In active noise reducing headphones it is known to use a headphone having front (inside) and rear (outside) cavities separated by a baffle carrying a small driver.

SUMMARY OF THE INVENTION

According to the invention, the driver is a high compliance driver. According to another feature of the invention, there is structure limiting the maximum excursion of the diaphragm. According to another feature of the invention, the diaphragm is formed with indentations having a component transverse to the circular grooves or corrugations near the diaphragm periphery. According to another aspect of the invention, the basket surface under the diaphragm has raised portions.

BRIEF DESCRIPTION OF THE DRAWING

Other features and advantages of the invention will become apparent from the following detailed description when read in connection with the accompanying drawing in which.

DETAILED DESCRIPTION

Figure 1:
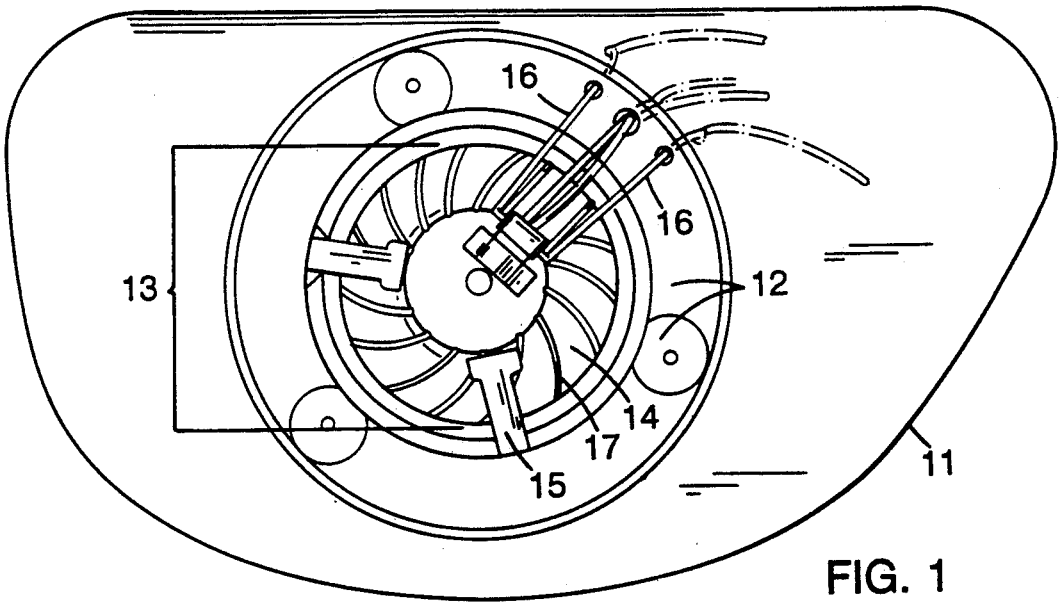
FIG. 1 is a plan view of a high compliance driver with the headphone cup generally illustrated to show the environment of the invention.
Figure 3:
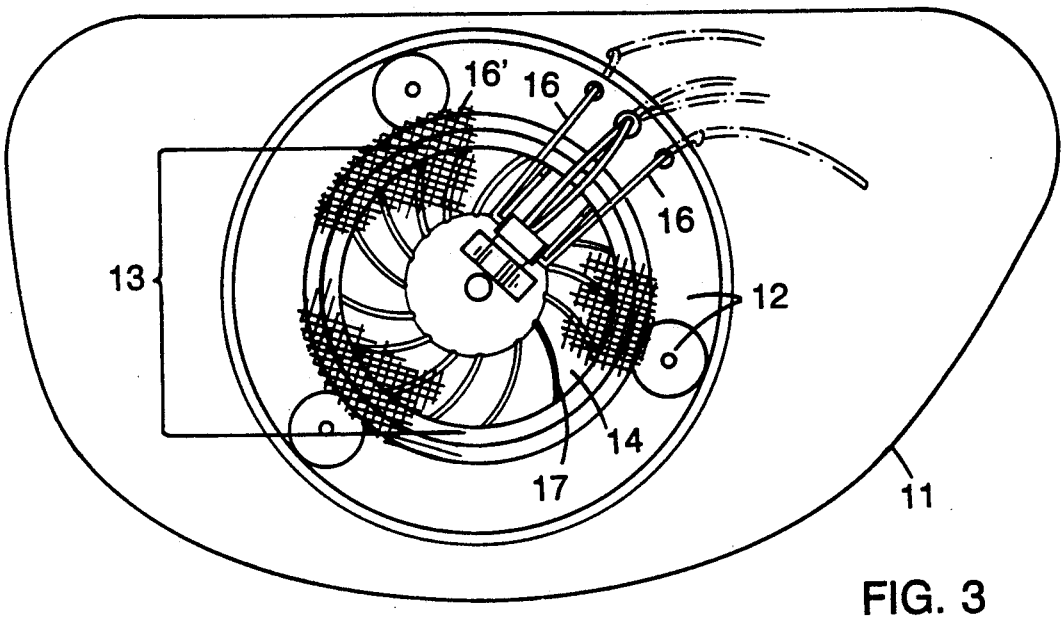
FIG. 3 is a plan view of another embodiment of the invention corresponding to FIG. 1 illustrating a fine wire mesh screen for limiting diaphragm excursion.

With reference now to the drawing, and more particularly FIG. 1 thereof, there is shown an embodiment of the invention. The invention includes a baffle 11 that separates a front or inside cavity from a rear or outside cavity and carries high compliance driver 13 having diaphragm 14. Plastic fingers 15 are equi-angularly spaced about the driver axis, extend radially inward and are positioned along the driver axial direction of motion so as to limit displacement of the diaphragm from its center or rest position to a plane sufficiently close to the rest plane with the diaphragm centered so that a portion of the voice coil is always in the air gap and sufficiently far from the central plane so that the diaphragm is free to translate axially without obstruction when normally reproducing sound with the headphones properly mounted on the head of the user. An active noise reduction system mounting structure 16 carries a microphone (FIG. 4) near the diaphragm used with associated electronic circuitry comprising a system corresponding substantially to the active noise reducing system disclosed in U.S. Pat. Nos. 4,644,581 and 4,455,675 incorporated herein by reference.

Figure 2:
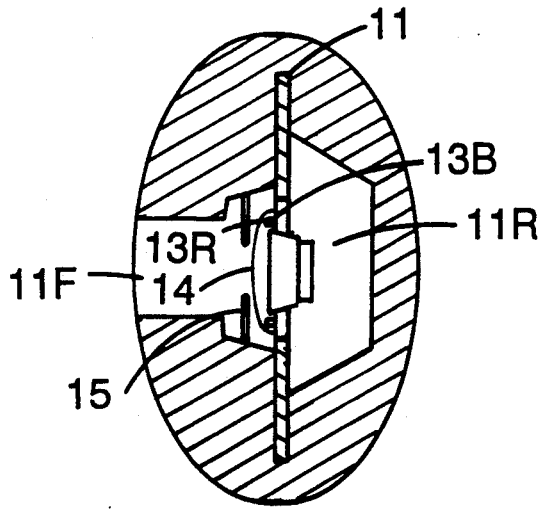
FIG. 2 is a diagrammatic axial sectional view of elements in FIG. 1.

Referring to FIG. 2, there is shown a diagrammatic sectional view generally patterned after the sectional view of the aforesaid U.S. Pat. No. 4,644,581 with headphone cup structure added to better illustrate the relationship among the front cavity, rear cavity, high compliance drive and raised portions on the basket surface. Baffle 11 separates front or inside cavity 11F from rear or outside cavity 11R and carries high compliance drive 13 having diaphragm 14 and may have the driver basket surface 13B formed with raised portions 13R.

Having described the physical arrangement of an exemplary embodiment, it is appropriate to consider certain principles. It is convenient to refer to the cavity nearer the user and encompassing his ear with headphones properly positioned as the front or inside cavity and the cavity further from the user as the rear or outside cavity. It is desirable to keep the front cavity volume as small as practical to maximize the sound pressure that the small driver produces at the ear canal to cancel low frequency noise. However, to increase passive transmission attenuation for ambient noise penetrating an ear cup sealed around the ear by a cushion, it is desirable to make the front cavity volume large.

It has been discovered that the effective air volume which determines this transmission attenuation is not simply the volume of the front cavity but also a function of the driver compliance (below its free air resonance frequency) and the volume of the rear cavity. If $C_f$ is the compliance of the front cavity air volume, $C_r$ is the compliance of the rear cavity air volume and $C_d$ is the compliance of the driver, then the effective compliance $C_{eff}$ determining passive transmission attenuation is the front cavity compliance in series with the parallel combination of the driver compliance and the rear cavity compliance, or $$C_{eff} = C_f + C_r C_d/(C_r + C_d)$$

below the free air resonance of the driver.

Since compliance of an enclosed quantity of air is proportional to the volume, for a given ear cup volume divided into front and rear cavities, it can be shown that the effective compliance $C_{eff}$ is maximized by maximizing the driver compliance. Thus, a driver with very high compliance (low stiffness) and low mass (so as to resonate with the high compliance at as high a frequency as practical), effects significant improvements in passive transmission attenuation below driver free air resonance without audibly affecting sound reproduction. In the limit, if the compliance of the driver is much greater than the compliance of the air in the rear cavity, the effective compliance is equal to the sum of the rear cavity and front cavity compliances, $C_f + C_r$.

High compliance herein means the driver compliance is greater than the rear cavity compliance.

Another advantage of high compliance drivers is that at very low frequencies (below the rear cavity port resonance when the rear cavity is ported), higher driver compliance results in higher system efficiency. This increase in efficiency reduces the electrical power required to generate sound pressures needed to cancel high levels of low frequency noise. This feature is particularly advantageous in battery-powered active noise reduction headsets and hearing protectors.

When the ear opening in the headset is sealed against the head or any other surface, motion of the earcup relative to that surface changes the volume of the front cavity. Slight changes in volume result in tremendous subsonic pressures. If the volume is increased, such as when the earcup is removed from the head after the cushion was sealed tightly to the head, the under-pressure generated tends to pull the driver diaphragm toward the opened end of the earcup. Since high compliance, low mass drivers move very freely, this pressure can very easily pull the voice coil outside of the gap beyond its normal maximum range of excursion, with the risk that it may catch on the driver basket or magnet and not return to its nominal rest position upon release of the under-pressure. If the volume is decreased, such as when the earcup is pushed suddenly against the head, the over-pressure generated can cause the thin, flexible diaphragm to collapse from its normal shape. Drivers with diaphragms formed from thin plastic films usually are formed with angled grooves or corrugations in the outer annulus between the voice coil and the edge of the diaphragm. These grooves expand and contract as the voice coil moves and help assure linearly, piston like motion. Under the over-pressure conditions described above, these grooves may irreversably change shape, and prevent the driver diaphragm from returning to its normal shape and position.

The invention avoids the suction or under-pressure problem by locating a structure in the earcup over the diaphragm to limit voice coil excursion. This structure 15 is positioned such that, during the normal range of excursion of the driver diaphragm, the diaphragm does not touch structure 15 and motion is unimpeded. Structure 15 is located close enough to the driver such that it contacts the diaphragm before it is pulled so far that the voice coil is pulled fully from the gap. Since the voice coil is not pulled from the gap, when the suction is released, the coil will return to its normal rest position and not hang up on the basket. The structure 15 is preferably small enough so that it does not cause diffraction or otherwise affect the sound pressure detected by the active noise reduction system's microphone except at high frequencies (above 10 KHz). The present invention accomplishes this by using three small fingers of plastic 15 positioned to symmetrically contact the diaphragm along the circle where the voice coil is glued to it. Contacting the diaphragm with small point-like fingers anywhere but along the voice coil might risk possibly puncturing or otherwise damaging the diaphragm. An alternative embodiment for the structure to stop diaphragm motion is a fine wire mesh screen 16' shaped so as to contact as much of the surface of the diaphragm as possible at its position of maximum allowed outward excursion. By contacting over a large area, the pressure at any point is small enough so as not to damage the driver.

The present invention avoids the driver collapse or over pressure problem by using a driver whose diaphragm recovers its shape when collapsed. Changing the shape of the grooves or corrugations by including indentations 17, having a radial component in the diaphragm such that the diaphragm recovers its shape if collapsed, prevents unrecoverable collapse. An alternative solution is to change the shape of the metal basket to which the diaphragm is attached or to add a structure to the basket. Commonly the basket surface under the diaphragm is flat. By raising this surface at some points it can be made to support the diaphragm in over-pressure situations, preventing it from collapsing to the point that permanent damage or change in shape occurs.

A preferred form of the invention involves combining the driver mounting structure, active noise reduction system microphone mounting structure, and driver under-pressure excursion stops into a single plastic piece molded in one shot. This approach reduces the effect of mechanical tolerance build-up and positions all parts accurately so as to provide consistent performance. This structure could be further combined with the baffle separating front and rear cavities.

The specific apparatus functions as follows. When the headset is removed from the head causing an under pressure situation, limitation elements 15 limit the excursion of diaphragm 14 so that the voice coil doesn't escape the air gap. This structure ensures that diaphragm 14 will return to its nominal position. These limitation elements 15 do not interfere with the normal range of motion of diaphragm 14.

In an over-pressure situation such as when the headset is pressed against the head, grooves 17 in the surface of diaphragm 14 cause the diaphragm 14 to recover its original shape if collapsed by the increase in pressure. In another embodiment, raised points underneath the diaghragm 14 support it during over-pressure situations preventing a collapse.

In a specific embodiment of the invention, the front cavity volume is approximately 100 cc (cubic centimeters), and the rear cavity volume is also 100 cc. The driver has a free air resonance of 250 Hz and an acoustical compliance of ti $1\times10^{-9}$ (meters)$^5$/(Newtons).

This compliance is equivalent to a volume of 150 cc of air. The effective volume is thus $$V_{eff}=100+100*150/(100+150)=160 \text{ cc.}$$

The driver diaphragm is formed of mylar which is 1 mil thick The driver is mounted in a plastic baffle with three under-pressure excursion stops placed to contact the diaphragm at approximately 30 mils excursion. Under maximum operating conditions (high noise and communication levels) driver excursion does not exceed 20 mils. Rear cavity port tuning is set to 90 Hz. Port tuning is chosen based on need for increased driver output for noise cancellation in 50–80 Hz range without compromising passive attenuation. A much larger rear cavity would eliminate need for a port in rear cavity, but would compromise styling.

Figure 4:
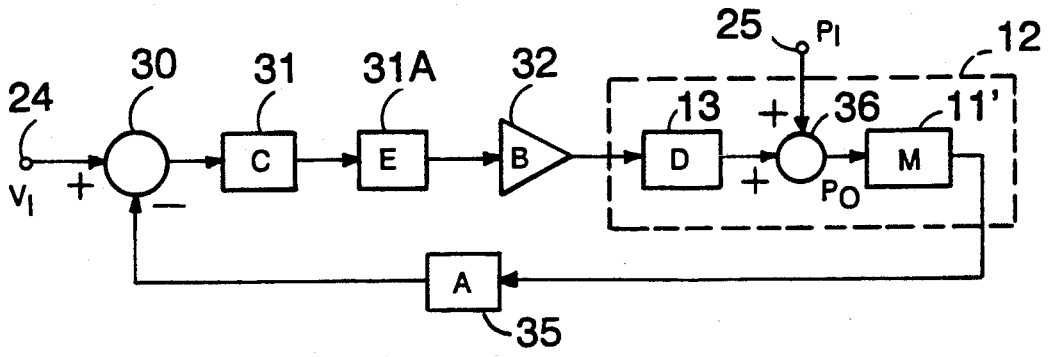
FIG. 4 is a block diagram illustrating the logical arrangement of an active noise reduction system embodying the invention.

Referring to FIG. 4, there is shown a block diagram illustrating the logical arrangement of a system incorporating the invention corresponding substantially to FIG. 1 of the aforesaid '581 patent. A signal combiner 30 algebraically combines the signal desired to be reproduced by the headphones on input terminal 24 with a feedback signal provided by microphone preamplifier 35. Signal combiner 30 provides the combined signal to compressor 31 which limits the level of the high level signals. The output of compressor 31 is applied to compensator 31A. Compensator 31A includes compensation circuits to insure that the open loop gain meets the Nyquist stability criteria, so that the system will not oscillate when the loop is closed. The system shown is duplicated once each for the left and right ears.

Power amplifier 32 amplifies the signal from compensator 31A and energized headphone driver 13 through voice coil 13C to provide an acoustical signal in cavity 11F that is combined with an outside noise signal that enters cavity 11F from a region represented as acoustical input terminal 25 to produce a combined acoustic pressure signal in cavity 11F represented as a circle 36 to provide a combined acoustic pressure signal applied to and transduced by microphone 11'. Microphone amplifier 35 amplifies the transduced signal and delivers it to signal combiner 30.

Other embodiments are within the claims.

What is claimed is:

1. A headset comprising:

at least one earcup having a front cavity and rear cavity with front cavity and rear cavity compliances respectively, a baffle separating the front and rear cavities, a high compliance driver with a driver compliance that is greater than said rear cavity compliance having a diaphragm joined to a voice coil normally residing in a gap mounted on the baffle, and an active noise reduction system coupled to said driver.

2. A headset in accordance with claim 1 and further comprising limiting structure limiting the maximum excursion of the diaphragm so that the voice coil remains at least partially in said gap.

3. The headset set forth in claim 2 wherein said limiting structure comprises a plurality of plastic elements, placed such that said plastic elements contact the diaphragm where the voice coil is joined to said diaphragm.

4. The headset set forth in claim 2 wherein said limiting structure comprises a fine wire mesh screen shaped so as to contact as much of the surface of the diaphragm as practical at its position of maximum allowed outward excursion, preventing further movement.

5. The headset set forth in claim 1 and further comprising means for recovering from collapse of the diaphragm including indentations in the diaphragm such that the diaphragm recovers its shape if collapsed.

6. The headset set forth in claim 1 and further comprising raised portions on the surface underneath the diaphragm preventing unrecoverable collapse of said diaphragm.

* * * * *

UNITED STATES PATENT AND TRADEMARK OFFICE

CERTIFICATE OF CORRECTION

PATENT NO. : 5,181,252

DATED : January 19, 1993

INVENTOR(S) : Roman Sapiejewski

It is certified that error appears in the above-indentified patent and that said Letters Patent is hereby corrected as shown below:

On the title page: Item [75]

line 2, "Sapiejewski et al." should read --Sapiejewski--.

"Roman Sapiejewski, Boston; John J. Breen, Southboro, both of Mass." should read --Roman Sapiejewski, Boston, Mass.--.

Signed and Sealed this

Twelfth Day of April, 1994

Bruce Lehman

*Attest:*

BRUCE LEHMAN

*Commissioner of Patents and Trademarks*

*Attesting Officer*

UNITED STATES PATENT AND TRADEMARK OFFICE
Certificate

Patent No. 5,181,252

Patented: January 19, 1993

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Roman Sapiejewski, Boston, MA (US); and John J. Breen, Southboro, MA (US).

Signed and Sealed this Thirtieth Day of June 2009.

JASON CHAN
*Supervisory Patent Examiner*
Art Unit 2622